US010236558B2

(12) United States Patent
Mai

(10) Patent No.: US 10,236,558 B2
(45) Date of Patent: Mar. 19, 2019

(54) LTE FULL-BAND CELLPHONE ANTENNA STRUCTURE

(71) Applicant: Jianchun Mai, Shenzhen (CN)

(72) Inventor: Jianchun Mai, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 25 days.

(21) Appl. No.: 15/416,913

(22) Filed: Jan. 26, 2017

(65) Prior Publication Data

US 2017/0324151 A1 Nov. 9, 2017

(30) Foreign Application Priority Data

May 3, 2016 (CN) ..... 2016 1 0284245

(51) Int. Cl.

| | |
|---|---|
| ***H01Q 1/24*** | (2006.01) |
| ***H01Q 5/50*** | (2015.01) |
| ***H01Q 1/48*** | (2006.01) |
| ***H01Q 3/24*** | (2006.01) |
| ***H01Q 5/328*** | (2015.01) |
| ***H01Q 5/335*** | (2015.01) |

(52) U.S. Cl.

CPC ..... *H01Q 1/243* (2013.01); *H01Q 1/48* (2013.01); *H01Q 3/24* (2013.01); *H01Q 5/328* (2015.01); *H01Q 5/335* (2015.01); *H01Q 5/50* (2015.01)

(58) Field of Classification Search

CPC . H01Q 1/241–1/243; H01Q 1/48–1/50; H01Q 3/24; H01Q 5/50

See application file for complete search history.

(56) References Cited

U.S. PATENT DOCUMENTS

| | | | | |
|---|---|---|---|---|
| 8,948,827 | B2 * | 2/2015 | Wei | H01Q 1/243 343/700 MS |
| 2014/0266922 | A1 * | 9/2014 | Jin | H01Q 21/28 343/702 |
| 2014/0266938 | A1 * | 9/2014 | Ouyang | H01Q 5/321 343/729 |
| 2016/0049720 | A1 * | 2/2016 | Hwang | H01Q 1/243 343/702 |

* cited by examiner

*Primary Examiner* — Dameon E Levi
*Assistant Examiner* — Hasan Z Islam
(74) *Attorney, Agent, or Firm* — Na Xu; IPro, PLLC

(57) ABSTRACT

Provided is an LTE full-band cellphone antenna structure, including a ground plate, a circuit board having a feeding point, a feeding terminal matching circuit provided on the circuit board and a metal unit surrounding the circuit board and the ground plate. The metal unit includes a grounding portion electrically connected with the ground plate and a non-grounding portion electrically disconnected with the grounding portion. The feeding point is electrically connected with the non-grounding portion so that the non-grounding portion serves as a middle-high frequency radiator. A gap is provided between the non-grounding portion and the ground plate, and the ground plate is excited in a coupling manner so as to generate a current, such that the ground plate serves as a low frequency radiator. The antenna of the present disclosure covers all LTE frequency bands, which has advantages of less tuning difficulty and less influence by processing accuracy.

4 Claims, 5 Drawing Sheets

LTE FULL-BAND CELLPHONE ANTENNA STRUCTURE

TECHNICAL FIELD

The present disclosure relates to the field of mobile communications and, in particular, to an LTE full-band cellphone antenna structure for a mobile electronic device.

BACKGROUND

Antenna is used for transmitting or receiving radio waves, so as to transfer or exchange radio signals. Electronic devices with wireless communication function, for example cellphone, personal digital assistant, laptop etc., generally access to wireless network through a built-in antenna. At present, electronic devices adopting metal frame are more and more popular to the mass consumers.

Cellphone antenna in the related art usually adopts a metal frame with a fracture as the radiator, in addition, a single or multiple radiators with a flexible printed circuit (Flexible Printed Circuit, FPC) or laser direct structuring (Laser Direct Structuring, LDS) form may also be adopted. However, antenna with FPC or LDS form exists certain problems, for example, difficulty on antenna pattern tuning and frequency offset brought by processing accuracy tolerance.

Therefore, there is a need to provide a new LTE full-band cellphone antenna structure.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and following embodiments.

Figure 1:
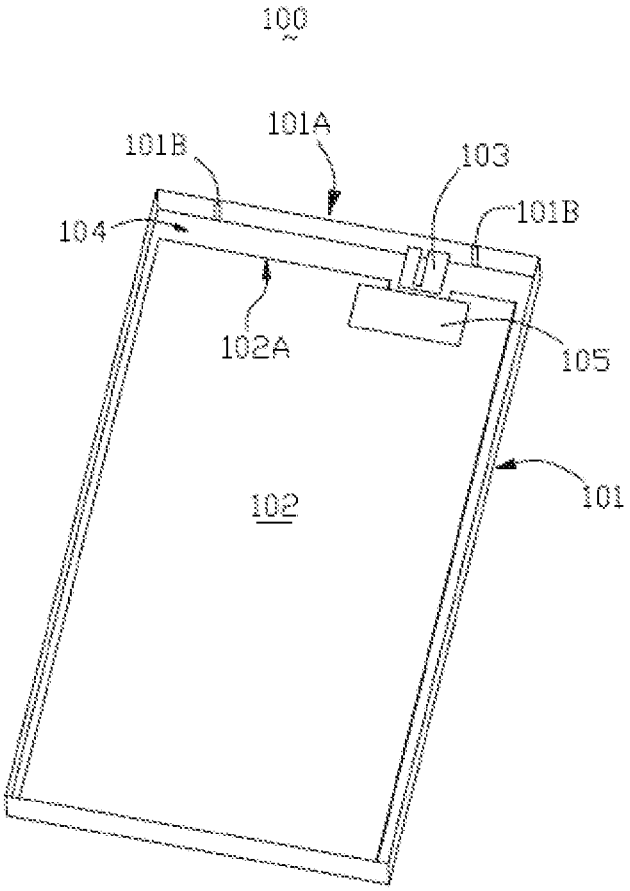
FIG. 1 is a structural schematic view of a LTE full-band cellphone antenna structure in accordance with the present disclosure.
Figure 2:
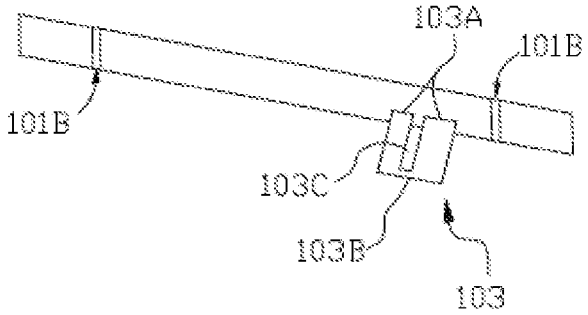
FIG. 2 is a connection structural view of a high frequency radiator and a duplex feeding unit in a LTE full-band cellphone antenna structure in accordance with the present disclosure.
Figure 3:
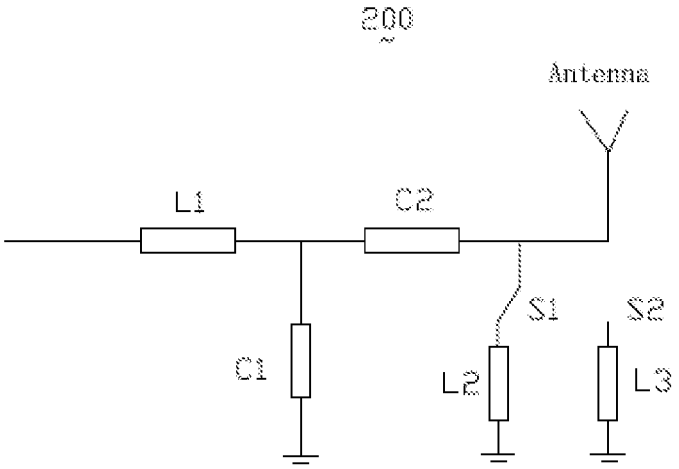
FIG. 3 is a structural schematic view of a feeding terminal matching circuit in a LTE full-band cellphone antenna structure in accordance with the present disclosure.

As shown from FIG. 1 to FIG. 3, an LTE full-band cellphone antenna structure 100 includes a ground plate 102, a circuit board 105 having a feeding point and a metal unit arranged surrounding the circuit board and the ground plate 102. In the present disclosure, the metal unit is a metal frame 101 of a cellphone.

The metal frame 101 is of a rectangular shape, which has four side edges. A shape of the ground plate 102 is the same with that of the metal frame 101, which has a pair of short edges and a pair of long edges. A gap 104 is provided between a short edge 102A and a relative shorter side edge of the metal frame. The relative shorter side edge is provided with two slottings 101B which are arranged in parallel to and spaced with each other, the portion between the two slottings is a non-grounding potion 101A, other portions of the metal frame 101 are electrically connected with the ground plate 102 and is electrically disconnected with the non-grounding portion 101A.

Actually, the electrical connection between the feeding point and the non-grounding portion 101A makes the non-grounding portion 101A be a high frequency radiator in the antenna structure, and the non-grounding portion 101A is not connected with the ground plate, thus the non-grounding portion 101A actually corresponds to a capacitive coupling element, when the non-grounding portion 101A is close enough to the short edge of the ground plate 102, the ground plate 102 is exited to generate a current, so that the ground plate 102 can serve as the low frequency radiator of the antenna structure. Therefore, radiators of FPC or LDS form can be omitted, which reduces the tuning difficulty, and is not affected by processing accuracy. When the non-grounding portion 101A is coupled with the ground plate 102 so that the ground plate 102 itself serves as the low frequency radiator, the antenna structure will have very wide working bandwidth, therefore, the antenna structure can operate at a needed frequency band through an external matching circuit. Comparing with conventional antennas (such PIFA), antenna with such structure has much smaller size.

As shown in FIG. 2, the antenna structure 100 further includes a duplex feeding unit having two feeding branches which are electrically connected with the non-grounding portions 101A. An end of the duplex feeding unit is electrically connected with the non-grounding portion 101A, the other end is electrically connected with the feeding point on the circuit board. When the duplex feeding unit is adjacent to a central point of the short edge, it can and only can excite low frequency on the ground plate 102. In the present disclosure, the duplex feeding unit is a metal sheet 103, the metal sheet 103 has a connecting end 103A electrically connected with the non-grounding portion 101A and a free end 103B arranged opposite to the connecting end 103A, the feeding point can be electrically connected with the metal sheet 103 at the free end 103B.

The two feeding branches of the metal sheet 103 are formed as follows: the metal sheet 103 is provided with a semi-closed slit 103C, the slit 103C extends to an edge of the connecting end 103A and forms an opening, so that the feeding unit 103 is divided into two portions which are connected with each other, the two portions are the two feeding branches of the metal sheet 103. The two feeding branches broaden working bandwidth in high frequency for the non-grounding portion 101A. Taking the position where the connecting end 103A is located as a boundary point, the side edge 101A between the two slottings 101B can be divided as a relative longer first radiating branch and a relative shorter second radiating branch.

Figure 4:
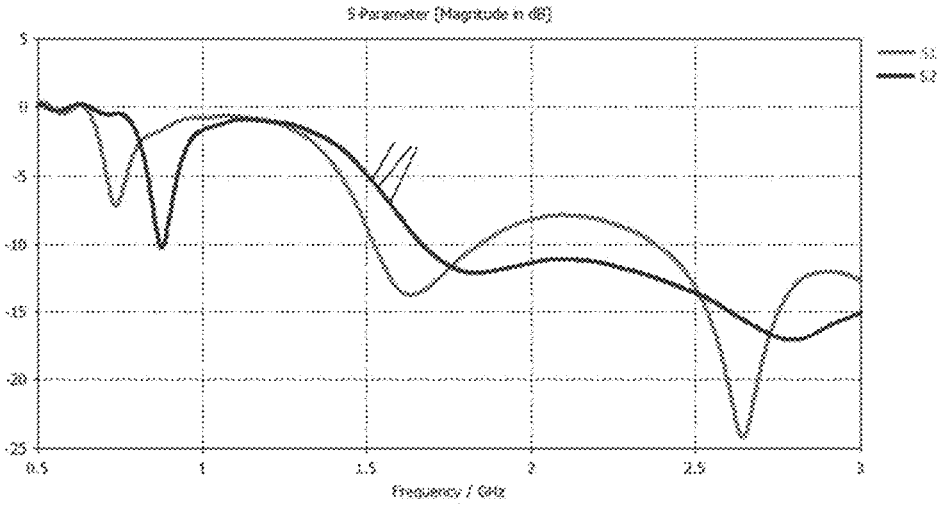
FIG. 4 is a view showing reflection characteristics of an antenna in a LTE full-band cellphone antenna structure in accordance with the present disclosure when a switch is in S1 and S2 position, respectively.
Figure 5:
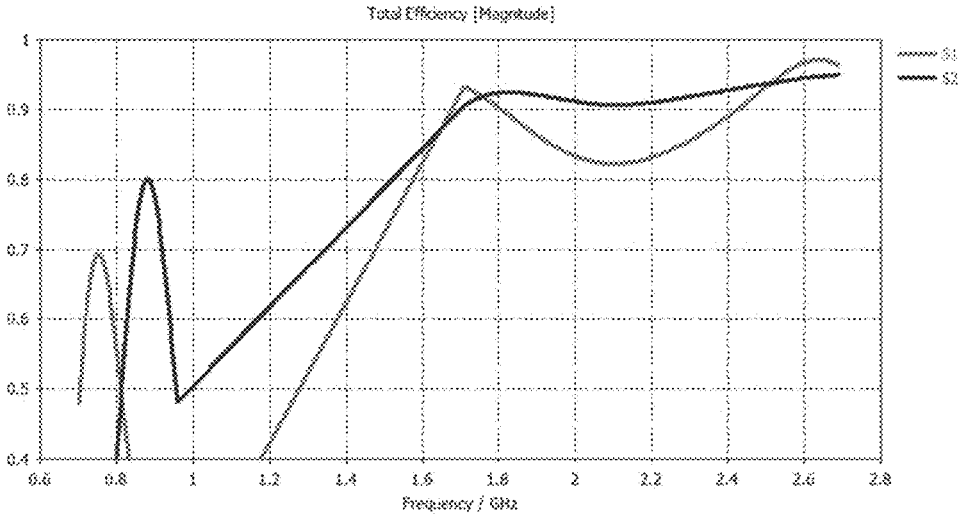
FIG. 5 is a view showing total efficiency of an antenna in a LTE full-band cellphone antenna structure in accordance with the present disclosure when a switch is in S1 and S2 position, respectively.

Due to the influence of the metal frame at the grounding portion, the low frequency portion of the antenna static bandwidth can only cover GSM frequency band (824-960 MHz), therefore the present disclosure adds a feeding terminal matching circuit 200 so as to achieve coverage on LTE full frequency bands. In the present disclosure, the feeding terminal matching circuit 200 mainly includes a switch S1 and two inductances L2 and L3 which are connected in parallel, which can achieve coverage on LTE full frequency bands through switching S1 to different inductances L2 and L3. To be specific, the feeding terminal matching circuit 200 includes an inductance L1, a capacitance C1 connected in parallel with the inductance L1, a capacitance C1 connected in series with the inductance L1, inductances L2 and L3 connected in parallel with the capacitance C2 and a switch which can be switched between the inductance L2 and inductance L3. L1=2 nH, L2=6.8 nH, L3=10 nH, C1=0.4 pF, C2=2 pF. When the switch is at the S1 position, frequency of 700-824 MHz can be generated; when the switch is at the S2 position, frequency of 824-960 MHz can be generated. In addition, the value of the inductance and the capacitance can be adjusted according to the required antenna performance FIG. 4 is a view showing reflection characteristics when a switch is in S1 and S2 position, respectively, FIG. 5 is a view showing total efficiency when a switch is in S1 and S2 position, respectively.

The above merely shows embodiments of the present disclosure, it should be noted that, improvements can be made by those skilled in the art without departing from the inventive concept of the present disclosure, however, these shall belong to the protection scope of the present disclosure.

What is claimed is:

1. A long term evolution (LTE) full-band cellphone antenna structure, comprising:

a ground plate;

a circuit board having a feeding point;

a feeding terminal matching circuit provided on the circuit board; and a metal unit surrounding the circuit board and the ground plate, wherein the metal unit comprises a grounding portion electrically connected with the ground plate and a non-grounding portion electrically disconnected with the grounding portion, the feeding point is electrically connected with the non-grounding portion so that the non-grounding portion serves as a high frequency radiator, a gap is provided between the non-grounding portion and the ground plate, and the ground plate is excited in a manner of coupling so as to generate a current, such that the ground plate serves as a low frequency radiator;

the metal unit is a metal frame provided surrounding the ground plate and the circuit board, the ground plate has a pair of long edges and a pair of short edges connected with the long edges, the metal frame has a side edge spaced with the short edge of the ground plate, the side edge has two slottings which are arranged in parallel and spaced with each other, a portion between the two slottings is the non-grounding portion;

the LTE full-band antenna structure further comprises a duplex feeding unit, the duplex feeding unit has two feeding branches electrically connected with the non-grounding portion;

the duplex feeding unit is a metal sheet, the metal sheet is provided with a semi-closed slit, the slit extends to an edge of the metal sheet and forms an opening, so as to form two feeding branches which are electrically connected with the non-grounding portion.

2. The LTE full-band cellphone antenna structure as described in claim 1, wherein the non-grounding portion takes the duplex feeding unit as a boundary point, a first portion from the duplex feeding unit to a slotting forms a first radiating branch, a second portion from the duplex feeding unit to another slotting forms a second radiating branch.

3. The LTE full-band cellphone antenna structure as described in claim 2, wherein a length of the first radiating portion is larger than or equal to a length of the second radiating portion.

4. The LTE full-band cellphone antenna structure as described in claim 1, wherein the feeding terminal matching circuit comprises two inductances which are arranged in parallel and a switch switchable between the two inductances.

* * * * *